US006437511B1

(12) United States Patent
Choi

(10) Patent No.: US 6,437,511 B1
(45) **Date of Patent: *Aug. 20, 2002**

(54) MAGNETRON HAVING CHOKE STRUCTURES WITH A GAP SPACING THEREBETWEEN

(75) Inventor: Byoung-Tae Choi, Seoul (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/097,678

(22) Filed: Jun. 16, 1998

(30) Foreign Application Priority Data

Jun. 16, 1997 (KR) ..... 97-24835

(51) Int. Cl.[7] ..... H01J 23/54; H01J 25/50
(52) U.S. Cl. ..... 315/39.51; 315/39.53
(58) Field of Search ..... 315/39.51, 39.53

(56) References Cited

U.S. PATENT DOCUMENTS 4,833,367 A * 5/1989 Harada ..... 315/39.53
5,089,744 A * 2/1992 Park ..... 315/39.51 X

FOREIGN PATENT DOCUMENTS

| | | | | |
|---|---|---|---|---|
| JP | 131437 | * | 6/1988 | ..... 315/39.53 |
| JP | 230640 | * | 9/1990 | ..... 315/39.51 |
| JP | 4032135 | * | 2/1992 | ..... 315/39.51 |
| JP | 4144037 | * | 5/1992 | ..... 315/39.51 |

* cited by examiner

*Primary Examiner*—Benny T. Lee

(57) ABSTRACT

A magnetron is disclosed in which the structure of the choke is altered, so that when designing the choke, the design allowance range is expanded so as to realize the optimum efficiency. Thus the unnecessary harmonic waves are more inhibited, and the coupling of the output part is improved owing to the impedance of the choke, thereby doubling the output and efficiency. The first choke includes: a first cylindrical body; a flange part extending from the top of the cylindrical body toward the anode seal; and a supporting means extending from the flange part toward the cylindrical body. The second choke includes: a cylindrical body; and a flange part extending from the top of the cylindrical body toward the anode seal. Thus the first and second chokes maintain a proper gap between them owing to the supporting means.

7 Claims, 8 Drawing Sheets height of first choke when the height of the second choke is 3.4mm height of second choke when the height of the first choke is 2.2mm

MAGNETRON HAVING CHOKE STRUCTURES WITH A GAP SPACING THEREBETWEEN

BACKGROUND OF THE INVENTION

1. Field of the Invention

The present invention relates to a magnetron, and particularly relates to a magnetron in which the structure of the choke is altered such that when designing the choke, the design allowance range is expanded so as to realize the optimum efficiency. Thus the unnecessary harmonic waves are more inhibited, and the coupling of the output part is improved due to the impedance of the choke, thereby doubling the output and efficiency.

2. Description of the Related Art

As shown in FIGS. 1 and 2, the conventional magnetron includes: a filament like cathode 1 disposed at the center of the interior; a cylindrical metal anode 2 installed around the cathode 1 to form an interaction space 3; a plurality of vanes 9 installed in a radiative form around the cathode 1, with one end each of the vanes 9 being fixed to the inside of the anode 2; an antenna feeder 11 with one end of it electrically connected to the vanes 9 to transmit electronic energy; permanent magnets 6 and 7 respectively attached to an upper yoke 4 and a lower yoke 5, for forming a closed magnetic circuit to supply magnetic fluxes to the interaction space 3 as shown in FIG. 1; a magnetic pole 8 for forming a magnetic circuit path; an anode seal 18 for serving as a magnetic circuit path and as a body support; and first and second chokes 20 and 21 for inhibiting the harmonic waves coming through the anode seal 18 as shown in FIG. 1.

In FIG. 1, reference code 10 indicates cooling fins, 12 indicates a ventilating tube, 13 indicates an antenna ceramic, 14 indicates an antenna cap, 15 indicates a choke coil for preventing the reverse flow of the harmonic waves toward the power source, 16 indicates a high voltage capacitor, 17 indicates a filter box for removing the unnecessary radiations coming along the supply line, and 19 indicates a filament seal.

The conventional magnetron for microwave ovens constituted as above will be described as to its operations referring to FIGS. 1 to 3.

First, the magnetic fields of the permanent magnets 6 and 7 form a closed magnetic circuit along the upper and lower yokes 4 and 5 and the magnetic poles 8, so that a magnetic field is formed within the interaction space 3 between the cathode 1 and the anode 2.

Then power is supplied to the cathode 1, so that an electric field is formed in the interaction space 3. Then owing to the interaction between the electric field and the magnetic field, the cathode 1 discharges thermionic electrons.

Then the thermionic electrons perform cycloid movements within the interaction space 3, i.e., within the plurality of resonance cavities which are formed by the plurality of the vanes 9. Thus a high frequency energy (hereinafter, referred to as "microwaves") which is an electron energy is generated. These microwaves are transmitted to the vanes 9, and then are supplied into the cavity of the microwave oven through the antenna feeder 11.

Under this condition, for example, microwaves of 2450 MHz are generated in the resonance cavities. Besides the fundamental waves, harmonic components having a frequency of integer multiple of that of the fundamental waves are generated simultaneously.

If these harmonic components together with the fundamental waves are supplied into the cavity of the microwave oven, then the shielding of the waves becomes much more difficult because the wavelengths of the harmonic waves are much shorter, with the result that the waves escape to the outside.

Even if the leaked harmonic waves are very weak, they cause serious harm to the human body. Further, they may interfere with the wireless communication. Therefore, in order to inhibit the leakage of the harmonic waves, a filter consisting of a coil and a capacitor is installed at the input side, and at the same time, first and second chokes 20 and 21 which take the form of a metal cylinder are coupled to the interior of the anode seal 18 of the output side.

The structures of the first and second chokes 20 and 21 are as shown in FIG. 3. The first and second chokes 20 and 21 are installed above and below respectively within the anode seal 18. The first choke 20 includes: a cylindrical body 20*a* for allowing the antenna feeder to pass through; and a flange part 20*b* extending from the bottom of the cylindrical body 20*a* toward the anode seal 18.

The second choke 21 includes: a cylindrical body 21*a* for allowing the antenna feeder to pass through; and a flange part 21*b* extending from the bottom of the cylindrical body 21*a* toward the anode seal 18.

The first and second chokes 20 and 21 are designed in the following manner. That is, if it is assumed that the wavelength of the harmonic waves to be removed is $\lambda$, then $\lambda/4$ is adopted as the basic dimension. Then by considering the flanging capacitance, the heights of the chokes are made slightly smaller than ¼ of the wavelength of the harmonic waves. In this case, however, the external conditions other than the choke height are not matched. As a result, an accurate design becomes difficult, and its application also becomes difficult. Therefore, the capability of inhibiting the harmonic components was limited.

Meanwhile, in order to assemble the first and second chokes 20 and 21 to the output part of the magnetron, there was employed a jig 22 which consists of a multi-stepped guide rod 22*a* and a base 22*b* for supporting the guide rod 22*a*.

By using this jig 22, the first and second chokes 20 and 21 are assembled in the following manner. That is, the second choke 21 is fitted to the guide rod 22*a*, and then the first choke 20 is fitted to it, in such a manner that the first and second chokes 20 and 21 should maintain a proper gap between them. In this state, a brazing is carried out to fix them to the anode seal 18.

This will be described in further detail. That is, the second choke 21 is positioned such that its flange part 21*b* should be disposed below. In this state, the cylindrical body 21*a* is fitted to the guide rod 22*a* until the second choke 21 is engaged to a second engaging step 22*c* of the guide rod 22*a*, so as to make the second choke 21 secured. Then the flange part 20*b* of the first choke 20 is positioned so as for it to be disposed below, and then the cylindrical body 20*a* of the first choke 20 is fitted to the guide rod 22*a* until it is engaged to a first engaging step 22*d*. Thus a gap is maintained between the first and second chokes 20 and 21.

Then in order to fix the first and second chokes 20 and 21, brazing stocks are inserted into the anode seal 18. Then they are passed through a high temperature hydrogen brazing furnace. Thus the brazing stocks are melted, and the respective parts are fixed.

Therefore, in the fixing method using the jig 22, the inside diameter of the cylindrical body 20*a* of the first choke 20 should be necessarily smaller than the inside diameter of the cylindrical body 21*a* of the second choke 21, if the assembling is to be possible. Thus a limit is imposed on designing the inside diameter which decisively affects the damping of fifth harmonic waves. Consequently, the fifth harmonic wave damping is lowered.

That is, the design should be such that the inside diameter of the first choke 20 should be smaller than that of the second choke 21. Therefore, when designing it by considering the surrounding conditions and the inside diameters of the chokes, the design allowance cannot but be limited.

Particularly, the heights of the chokes should be reduced by considering the flanging capacitance based on experiments, and therefore, an accurate decision of the choke dimensions becomes difficult, with the result that there is a limit in improving the damping of the leakage of the harmonic waves.

SUMMARY OF THE INVENTION

The present invention is intended to overcome the above described disadvantages of the conventional art.

Therefore it is an object of the present invention to provide a magnetron in which the structure of the choke is altered, so that when designing the choke, the design allowance range is expanded so as to realize the optimum efficiency, and that the damping of fifth harmonic waves is improved.

In achieving the above object, the magnetron according to the present invention includes: a cathode disposed at the center of the interior; an anode installed around the cathode to form an interaction space; a plurality of vanes installed around the cathode; an antenna feeder with one end of it electrically connected to the vanes to transmit electromagnetic energy from one of cavities; permanent magnets and magnetic poles for forming a closed magnetic circuit to supply magnetic fluxes to the interaction space; an anode seal made of a metal, for serving as a magnetic circuit path and as a body support; and first and second chokes fixed within the anode seal and having each a cylindrical body to make the antenna feeder pass through, for inhibiting the fifth harmonic component coming through the anode seal.

The first choke includes: a first cylindrical body; a first flange part extending from the top of the first cylindrical body toward the anode seal; and a supporting means extending from the first flange part in parallel to the first cylindrical body.

The second choke includes: a second cylindrical body; and a second flange part extending from the top of the second cylindrical body toward the anode seal. Thus the first and second chokes maintain a proper gap between them due to the supporting means.

The first choke includes: a first cylindrical body with its opening directed toward the anode, and having a height of 2.0–2.6 mm; and a first flange part extending from the top of the first cylindrical body toward the anode seal, the first choke being fixed on an inner upper portion of the anode seal. The second choke includes: a second cylindrical body having a height of 3.2–3.8 mm, and with its opening being directed in a direction same as that of the first cylindrical body; and a second flange part extending from the top of the second cylindrical body toward the anode seal. Thus the second choke maintains a gap of 1.4–1.8 mm from the lower end of the first cylindrical body.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENTS

FIGS. 4*a*, 4*b*, 4*c*, 5, and 6 illustrates the constitution of a first embodiment of the magnetron according to the present invention.

The general structure of the magnetron was described in the prior art, and therefore, its description will be skipped, but only the difference will be described.

Figure 4A:
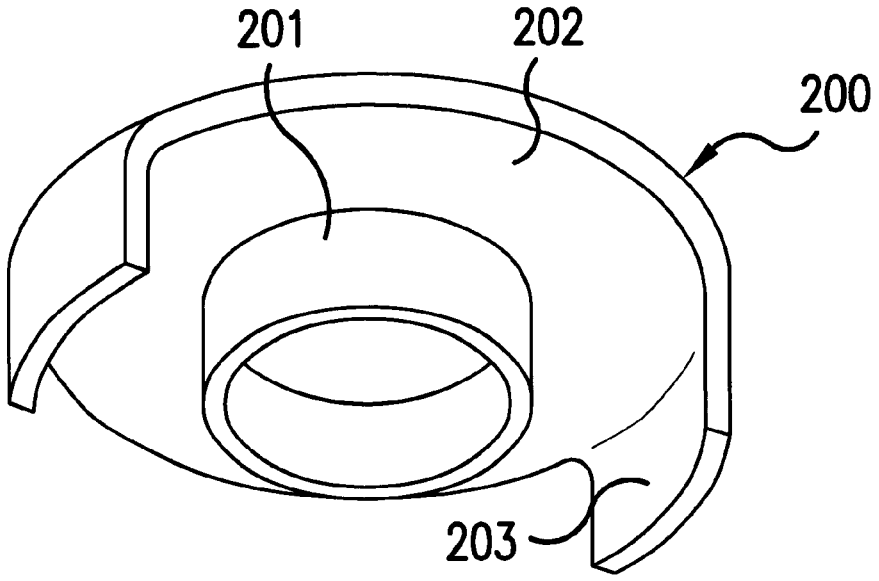
FIG. 4*a* is a bottom perspective view of the first choke according to the present invention, installed in the upper portion of the anode seal.

In the upper and lower portions of an anode seal 18, there are installed two chokes. Among them, as shown in FIG. 4*a*, a first choke 200 which is installed in the upper portion includes: a first hollow cylindrical body 201 for allowing an antenna feeder 11 (not shown) to pass through; and a first flange part 202 extending from the top of the first cylindrical body 201 toward the anode seal 18 (not shown).

Figure 1:
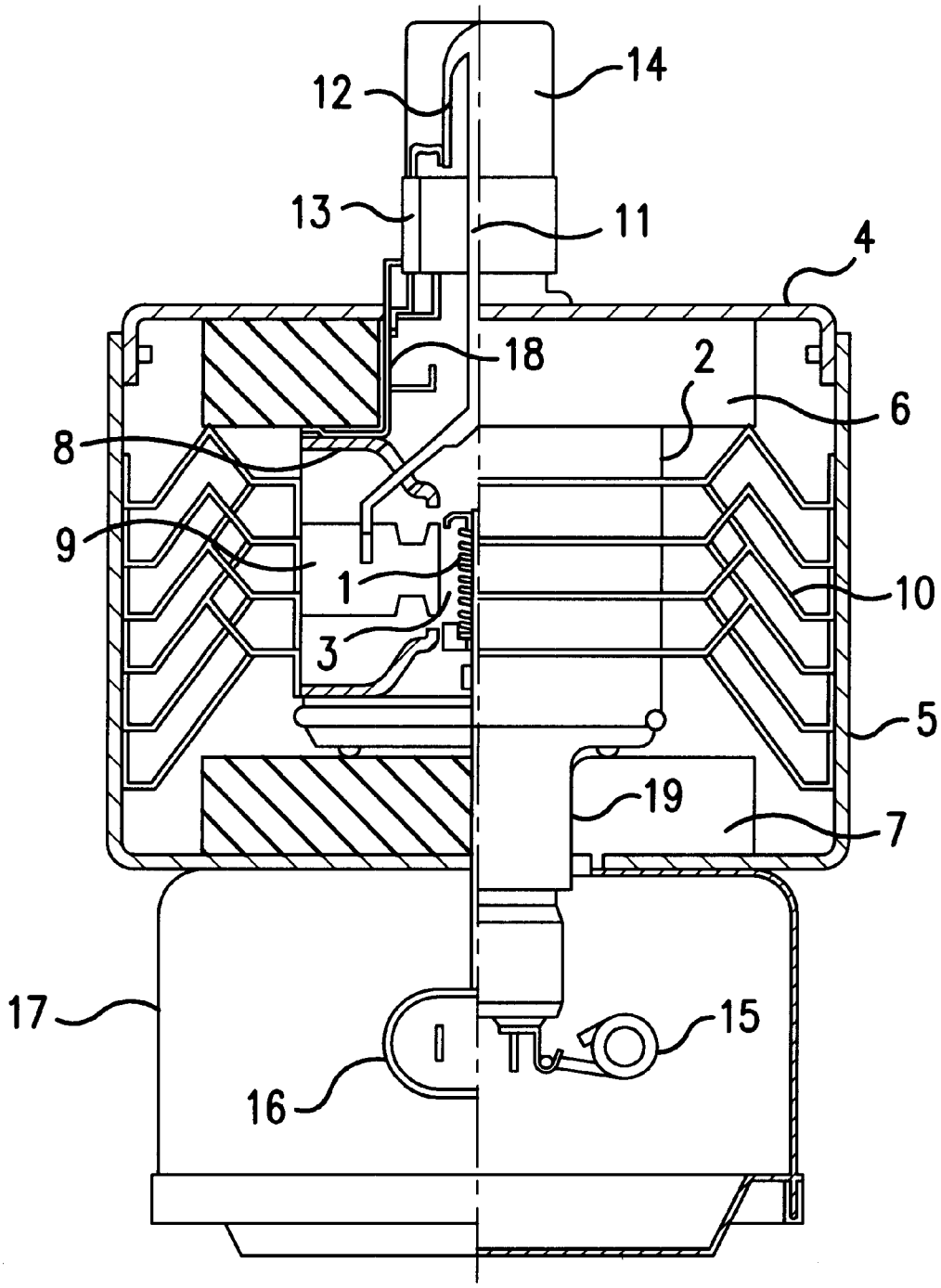
FIG. 1 PRIOR ART
FIG. 1 is a longitudinal sectional view showing an example of the prior art magnetron.
Figure 2:
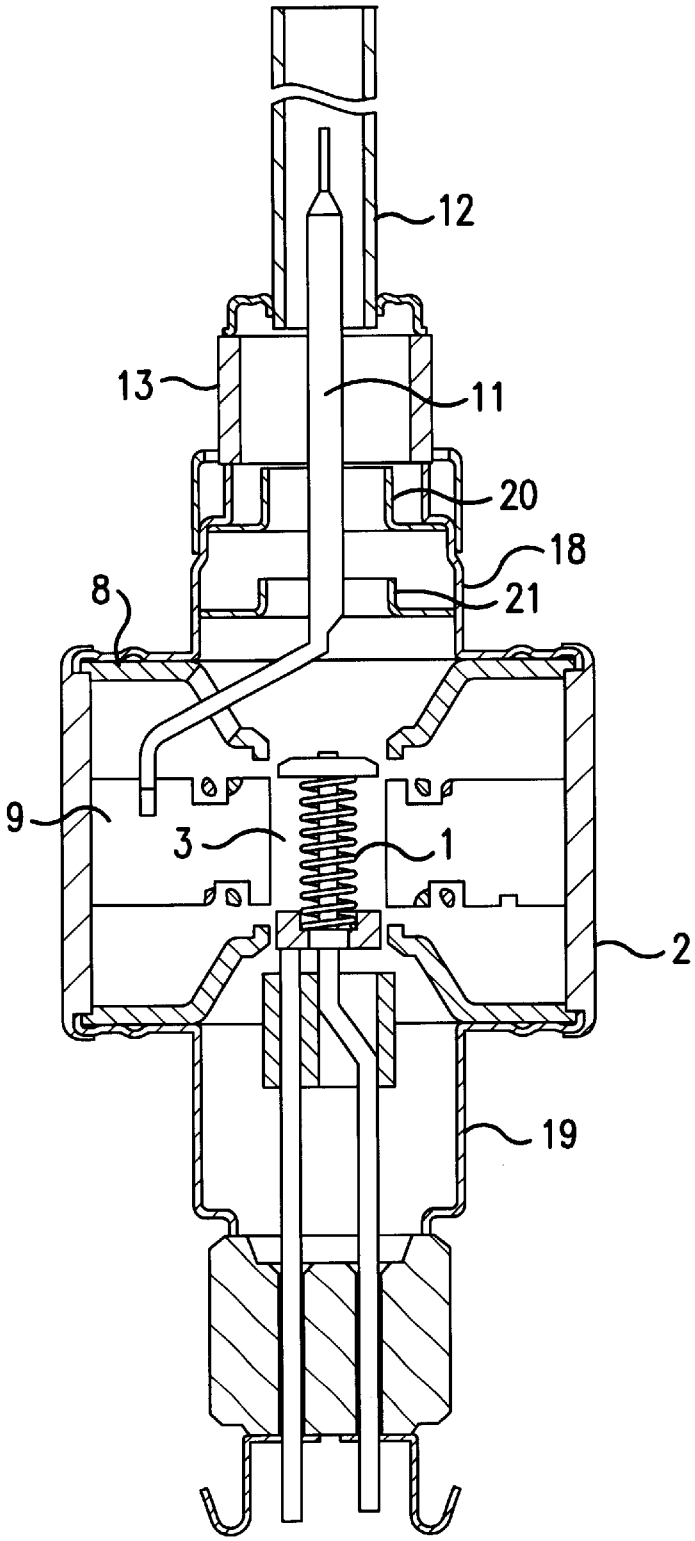
FIG.2 PRIOR ART
FIG. 2 is a longitudinal sectional view showing the anode of the prior art magnetron.
Figure 3:
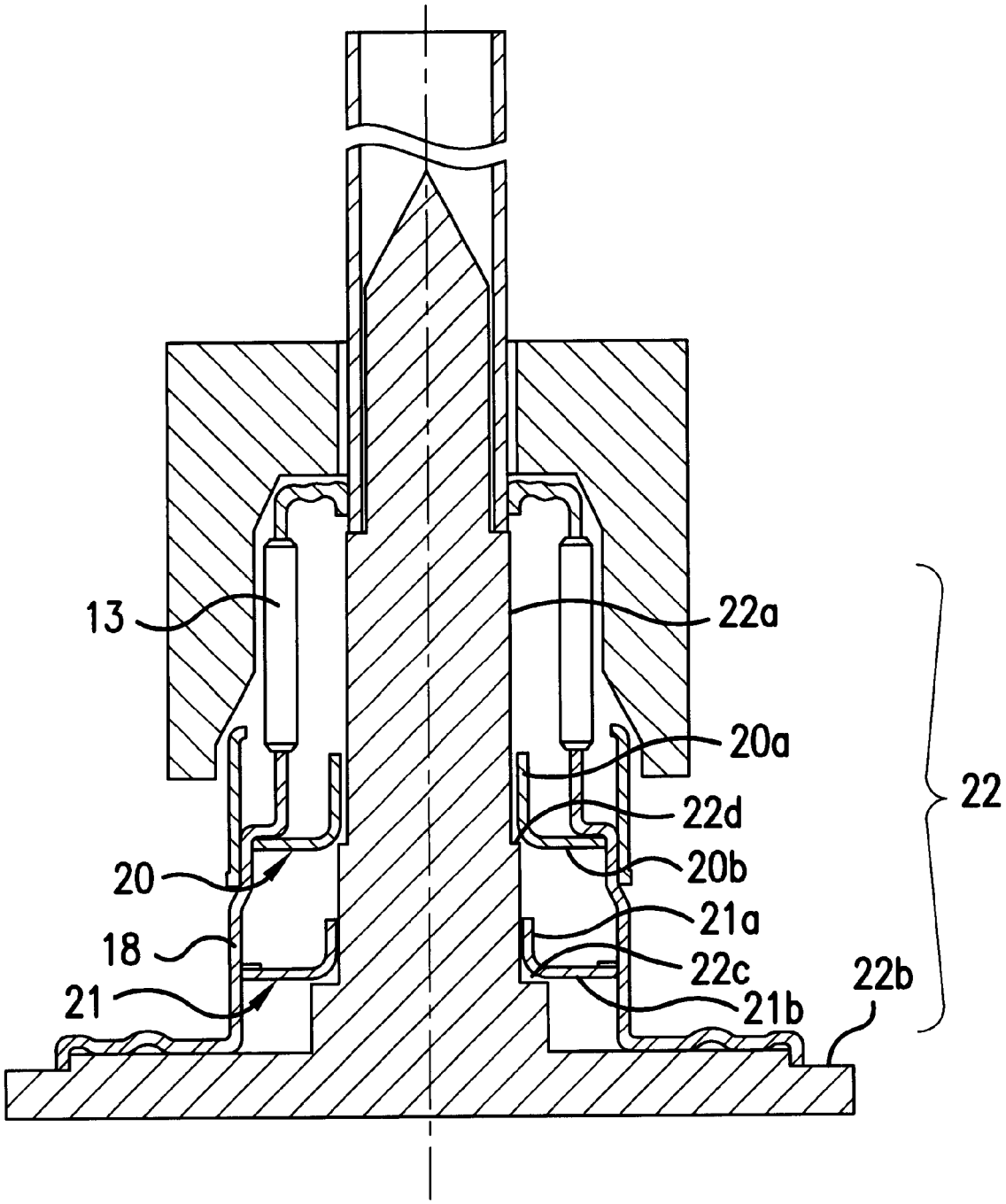
FIG.3 PRIOR ART
FIG. 3 is a longitudinal sectional view showing the prior art output side components coupled together by using a jig.

From the outer edge of the first flange part 202, there vertically extend a supporting means 203 toward a second choke 210 (see FIG. 2) until they contact with the second choke 210.

The lower ends of the supporting means 203 extend beyond the lower end of the cylindrical body 201, so that they can contact with the second choke 210.

Figure 4B:
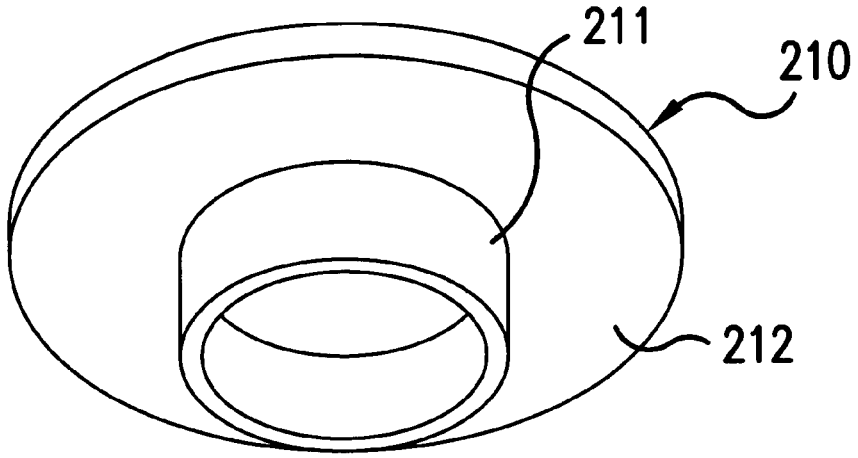
FIG. 4*b* is a bottom perspective view of the second choke according to the present invention, installed in the lower portion of the anode seal.

Meanwhile, as shown in FIG. 4*b*, the second choke 210 which is disposed under the first choke 200 includes: a second hollow cylindrical body 211 for allowing an antenna feeder 11 (not shown) to pass through; and a second flange part 212 extending from the top of the second cylindrical body 211 horizontally toward the anode seal 18 (not shown).

Figure 5:
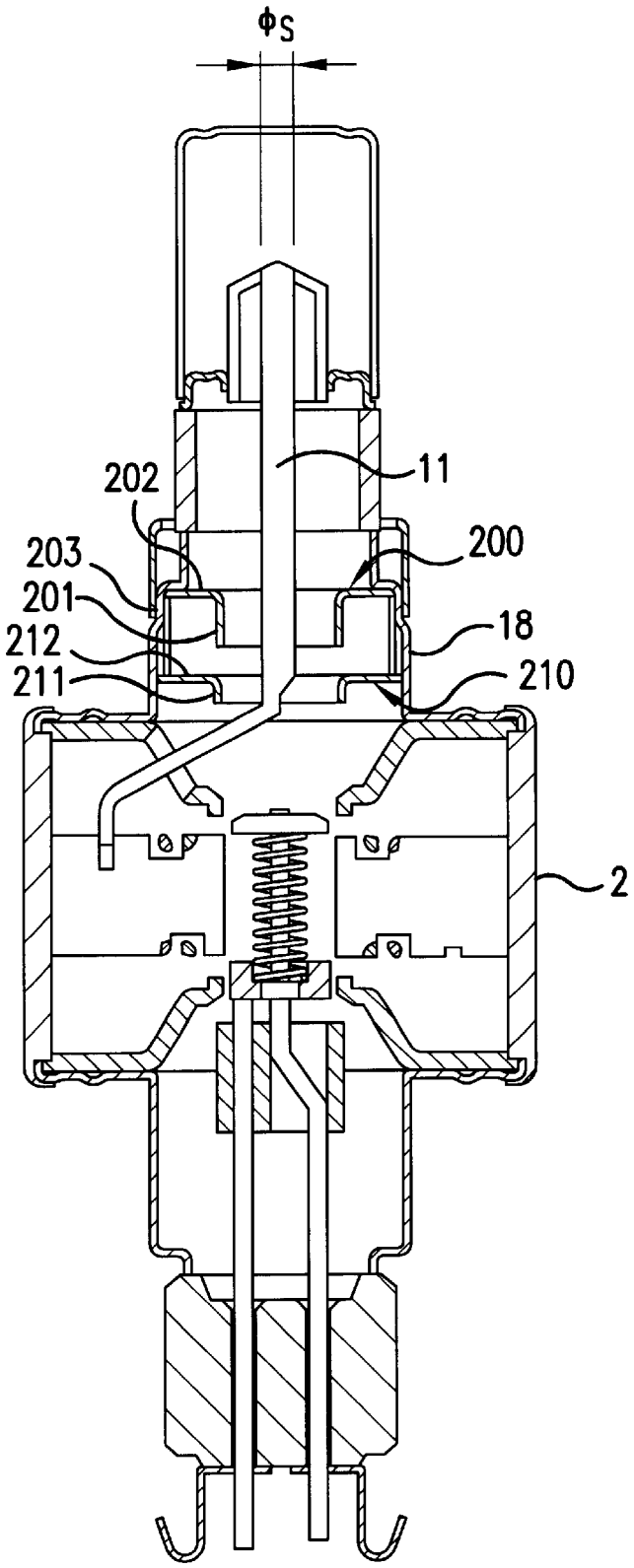
FIG. 5 is a longitudinal sectional view showing the anode of the magnetron with the first and second chokes of the present invention installed thereon.
Figure 6:
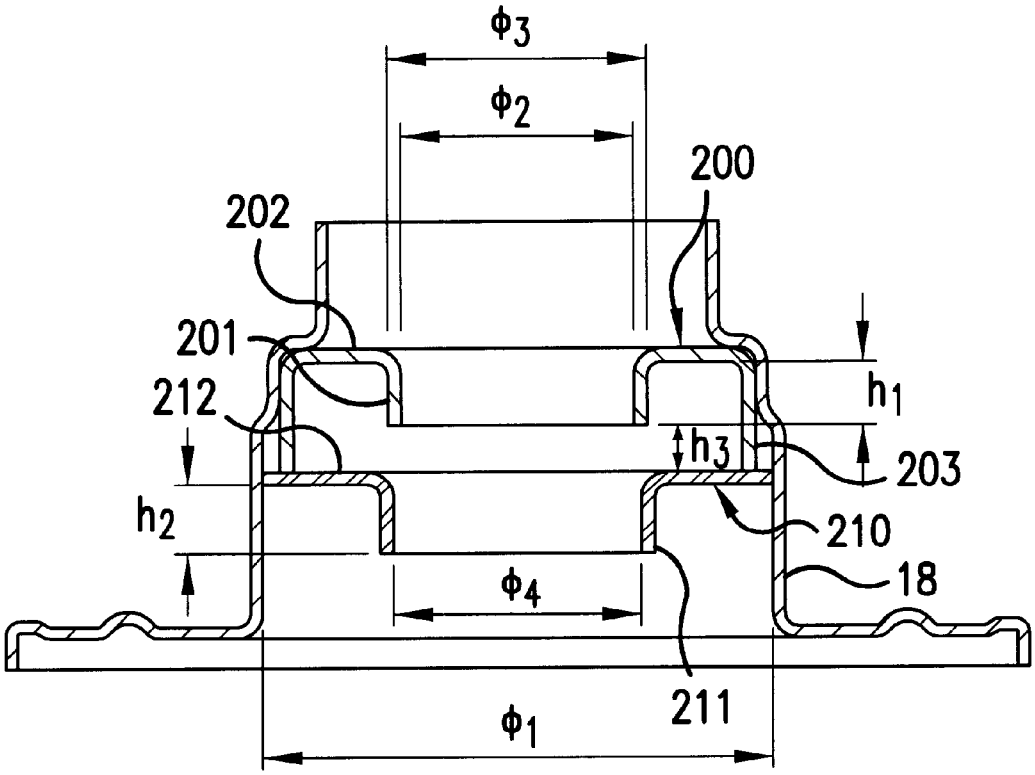
FIG. 6 is an enlarged sectional view showing the critical portion of FIG. 5.

If the first and second chokes 200 and 210 constituted as described above are to be fixed to the anode seal 18, the following procedure has to be carried out. That is, first a brazing is carried out to fix the outer edge of the first choke 200 to the inner upper part of the anode seal 18. A guide rod 22*a* (not shown) of a jig 22 (not shown) is inserted into the second cylindrical body 211 to secure the second choke 210. In this state, the anode seal 18 with the first choke 200 fixed therein is mounted upon the second choke 210. Thus as shown in FIGS. 5 and 6, the supporting means 203 of the first choke 200 are contacted to the second choke 210.

Under this condition, the first and second chokes 200 and 210 maintain a proper gap between them owing to the supporting means 203.

Then brazing stocks are inserted into between the bottoms of the supporting means 203 of the first choke 200 and the top of the second choke 210, and these are made to pass through a high temperature hydrogen brazing furnace to fix them together.

According to the above described coupling method, the coupling of the first choke 200 does not require the use of the jig 22. Therefore, when designing the inside diameter $\Phi_2$ (see FIG. 6) of the first cylindrical body 201 which is an important factor for damping the unnecessary harmonic waves, it can be designed with a free hand without being restricted by the dimension of the jig 22. That is, the inside diameter can be either expanded or narrowed.

However, there is the restriction that the second choke 210 can be assembled only by fitting it to the jig 22. Therefore the inside diameter $\Phi_4$ (see FIG. 6) of the second cylindrical body 211 cannot be varied, but the first choke 200 can be fixed into the anode seal 18 without the help of the jig 22. Therefore, at least the dimension of the inside diameter $\Phi_2$ of the first cylindrical body 201 can be designed to the optimum size. $\Phi_1$ in FIG. 6 is the inside diameter of the anode seal 10, and $\Phi_3$ is the outside diameter of the first cylindrical body 201.

Particularly, the following dimensions makes it possible to improve the damping of the harmonic waves. That is, the first cylindrical body 201 has a height h1 of 2.0–2.6 mm, and the second cylindrical body 211 has a height h2 of 3.2–3.8 mm. Further, the separation distance (gap) h3 from the lower end of the first cylindrical body 201 to the second choke 210 is 1.4–1.8 mm. With this design, the damping of the harmonic waves can be improved to the optimum degree.

Figure 7:
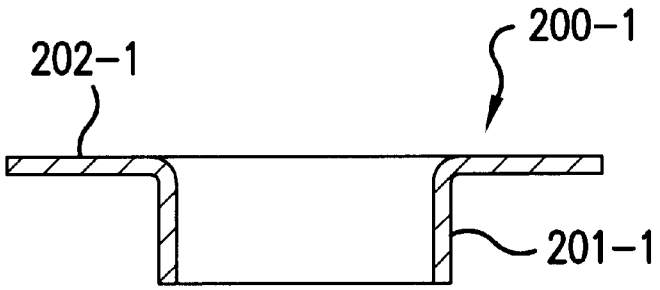
FIG. 7 is a longitudinal sectional view showing another embodiment of the first choke of the present invention.
Figure 8:
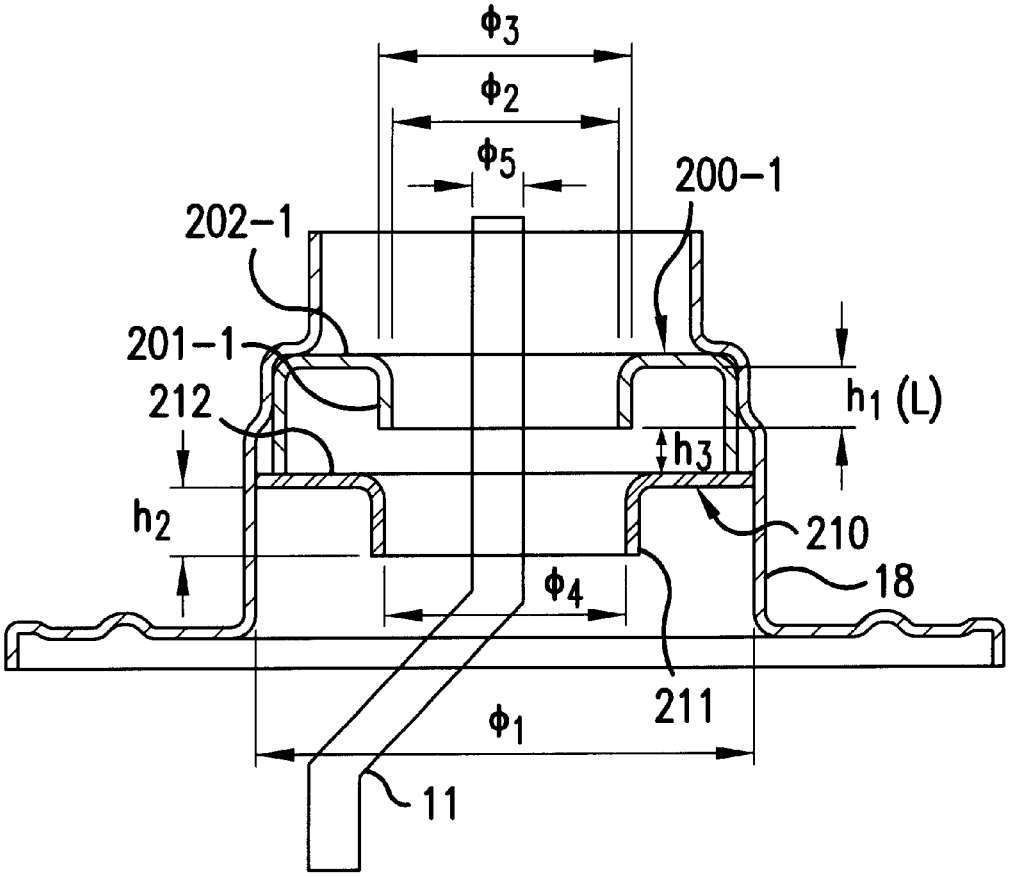
FIG. 8 is an enlarged sectional view showing the critical portion, with the second choke and the first choke of FIG. 7 installed therein.

Meanwhile, FIGS. 7 and 8 illustrate the constitution of a second embodiment of the magnetron according to the present invention. A first choke 200-1 of FIG. 7 has a constitution same as that of the first choke 200 of the first embodiment, except the supporting means 203.

That is, the first choke 200-1 includes: a first cylindrical body 201-1 (see FIG. 8); and a first flange part 202-1 extending from the top of the first cylindrical body 201-1 toward the anode seal 18. The second choke 210 includes: a second cylindrical body 211 having the same constitution as that of the first embodiment; and a second flange part 212 extending from the top of the second cylindrical body 211 toward the anode. Seal 18.

In the case of the first choke 200-1 which has no supporting means, the first and second chokes 200-1 and 210 can be assembled only by using the jig 22, this being a disadvantage. However, with the following arrangement of the dimensions, the effects of the second embodiment become same as those of the first embodiment. That is, the first cylindrical body 201-1 of the first choke 200-1 has a height h1 of 2.0–2.6 mm, and the second cylindrical body 211 of the second choke 210 has a height h2 of 3.2–3.8 mm. Further, the distance h3 from the lower end of the first cylindrical body 200-2 of the first choke 201-1 to the top of the second choke 210 is 1.4–1.8 mm as shown in FIG. 8. With this arrangement, the maximum damping capability is ensured.

Conventionally, when designing the chokes, an infinite impedance value is provided for a particular frequency of the microwave circuit, so that the current of the particular frequency cannot flow. That is, the method is that in which the height of the choke is designed to be $\lambda/4$. In contrast to this, in the present invention, the impedance for a particular frequency of the microwave circuit is made to be zero (short circuited state). Thus the inside diameters of the cylindrical metal bodies 201 (see FIG. 6), 201-1 and 211, the inside diameter of the anode seal 18, the diameter of the antenna feeder 11 passing through the cylindrical metal bodies and the like are collectively taken into account when designing the chokes. Thus the chokes are manufactured based on a serial resonance design, so that the chokes can give optimum effects.

Therefore, the chokes are designed in the following manner as shown in FIG. 8. That is, the inside diameter $\Phi_1$ of the anode seal, the inside diameter $\Phi_2$ of the first cylindrical body, the outside diameter $\Phi_3$ of the first cylindrical body, the outside diameter $\Phi_5$ of the antenna feeder (see FIG. 5), the wavelength $\lambda$ of the harmonic waves to be controlled, and the choke height (L) which is equal to the first choke's height $h_1$, are designed by applying the following formula: $\ln(\Phi_2/\Phi_5)\tan(2\pi L/\lambda)=\ln(\Phi_1/\Phi_3)\cot(2\pi L/\lambda)$ In the above formula, $\Phi_1$=19 mm, $\Phi_2$=9.0 mm, $\Phi_3$=10 mm, $\Phi_5$=2.5 mm were substituted, and a calculation was carried out. The result was that the damping of the harmonic waves was most efficient when the height of the first cylindrical body 201, 201-1 or 211 of the first choke 200 or 200-1 was about 3.7 mm.

Particularly, when the cylindrical metal bodies 201, 201-1 and 211 of the first and second chokes 200, 200-1 and 210 are facing toward below, that is, when they are facing toward the anode 2, the bottom of the cylindrical body 211 of the second choke 210 is closely near to the antenna feeder 11. Therefore, there is a possibility of contact. In order to prevent the contact, the height of the first cylindrical body 201 or 201-1 of the first choke 200 or 200-1 is made to be 2.0–2.6 mm, while in order to compensate the shortened distance, the distance h3 from the first cylindrical body 201 or 201-1 of the first choke 200 or 200-1 to the top of the second choke 210 is made to be 1.4–1.8 mm, thereby compensating it with the flanging capacitance value. Further, the height h2 of the second cylindrical body 211 of the second choke 210 is made to be 3.2–3.8 mm. With arrangement, the damping of the fifth harmonic waves can be improved to the maximum degree as shown in FIGS. 9*a* and 9*b*.

Further, the plurality of the supporting means 203 of the first choke 200 are bent downward, and therefore, there is formed an impedance between the supporting means 203 and the first cylindrical body 201, with the result that the coupling of the output part is reinforced. Consequently, the output and efficiency of the magnetron can be improved.

Figure 9A:
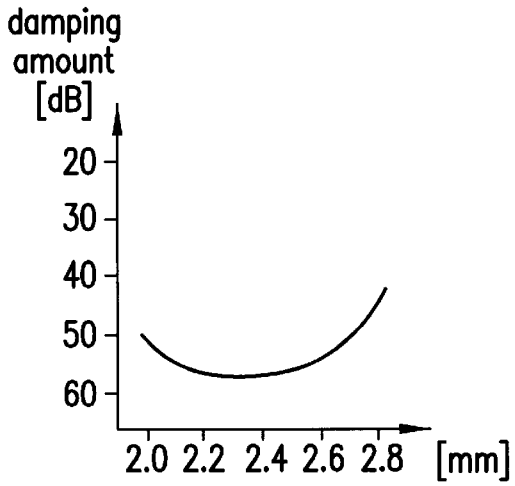
FIG. 9*a* is a graphical illustration showing the variation of the amount of the harmonic waves versus the height of the first choke.
Figure 9B:
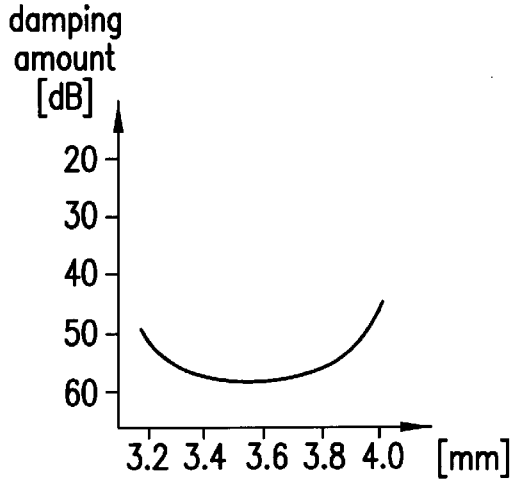
FIG. 9*b* is a graphical illustration showing the variation of the amount of the harmonic waves versus the height of the second choke.

Meanwhile, by referring to FIGS. 9*a* and 9*b*, the variation amount of the damping of unnecessary harmonic waves will be reviewed based on the figures calculated by the above described formula. FIG. 9*a* is a graphical illustration showing the variation of the amount of the harmonic waves versus the height h1 of the first cylindrical body 201 or 201-1 of the first choke 200. It is seen that the damping amount of the harmonic waves is largest when the height of the first cylindrical body 201 or 201-1 of the first choke is 2.0–2.6 mm.

Further, as shown in FIG. 9*b*, the damping amount of the harmonic waves is largest when the height $h_2$ of the second cylindrical body 211 is 3.2–3.8 mm.

Meanwhile, the inside diameter $\Phi_2$ of the first cylindrical body 201 or 201-1 of the first choke 200 or 200-1 should be preferably same as the inside diameter $\Phi_4$ of the second cylindrical body 211 of the second choke 210. The reason is that, according the repeated experiments, the harmonic wave damping capability is maximized when the inside diameters are same each other. Since the size of the inside diameter of the first choke 200 can be arbitrarily decided, it can be made fit to the inside diameter $\Phi_4$ of the second cylindrical body 211 of the second choke 210.

Meanwhile, the diameter $\Phi_1$ of the anode seal 18 for being fitted to the second choke 210 should be 18–20 mm if the improvement of the damping of the harmonic waves is to be maximized. This has to be taken into account when designing the anode seal.

According to the present invention as described above, the design allowance range is expanded when designing the chokes, and therefore, the harmonic wave damping capability can be significantly improved. Further, owing to the impedance formed in the chokes, the coupling of the output part is improved, to such a degree that the output and efficiency of the magnetron can be doubled.

What is claimed is:

1. A magnetron comprising:

a cathode disposed at a center of an interior of the magnetron;

an anode surrounding said cathode to define an interaction space;

a plurality of vanes surrounding said cathode and extending from said anode;

an antenna feeder electrically connected to said plurality of vanes;

an anode seal, for serving as a magnetic circuit path and as a body support;

a first choke comprising: a cylindrical body; a flange part extending from a top of said cylindrical body toward said anode seal; and a supporting means extending from said flange part in parallel to said cylindrical body, said first choke being fixed within said anode seal to be resonant with the wave length to be suppressed of high frequency energy generated by said magnetron, wherein the cylindrical body, the flange part, and the supporting means are integral; and a second choke comprising: a cylindrical body; and a flange part extending from a top of said cylindrical body of said second choke toward said anode seal, said second choke being fixed within said anode seal to be resonant with the wave length to be suppressed, and said first and second chokes maintaining a proper gap therebetween due to said supporting means of said first choke, and wherein said cylindrical body of said first choke has a height smaller than that of said supporting means, and said supporting means has a plurality of supporting elements.

2. The magnetron as claimed in claim 1, wherein said supporting means extend from said flange part of said first choke toward said anode to contact said flange part of said second choke so as to orient said cylindrical bodies of said first and second chokes toward said anode.

3. The magnetron as claimed in claim 1, wherein said cylindrical body of said first choke has an inside diameter identical to an inside diameter of said cylindrical body of said second choke.

4. The magnetron as claimed in claim 1, wherein said anode seal has an inside diameter of 18–20 mm.

5. The magnetron as claimed in claim 1, wherein said cylindrical body of said first choke has a height of 2.0–2.6 mm, said cylindrical body of said second choke has a height of 3.2–3.8 mm, a bottom of said cylindrical body of said first choke is separated from, a top of said second choke by a distance of 1.4–1.8 mm.

6. A magnetron comprising:

a cathode disposed at a center of an interior of the magnetron;

an anode surrounding said cathode to define an interaction space;

a plurality of vanes surrounding said cathode and extending from said anode;

an antenna feeder electrically connected to said plurality of vanes;

an anode seal, for serving as a magnetic circuit path and as a body support;

a first choke comprising: a cylindrical body having a height of 2.0–2.6 mm extending toward said anode; and a flange part extending from a top of said cylindrical body of said first choke toward said anode seal, said first choke being fixed within said anode seal to be resonant with the wave length to be suppressed of high frequency energy generated by said magnetron; and a second choke comprising: a cylindrical body having a height of 3.2–3.8 mm and having an opening orientation identical to an opening orientation of said cylindrical body of said first choke; and a flange part extending from a top of said cylindrical body of said second choke toward said anode seal, said second choke being fixed within said anode seal to be resonant with the wave length to be suppressed, and said first and second chokes maintaining a gap of 1.4–1.8 mm between closest portions of said first and second chokes, wherein said cylindrical body of said first choke has an inside diameter identical to that of said cylindrical body of said second choke.

7. The magnetron as claimed in claim 6, wherein said anode seal has an inside diameter of 18–20 mm.

* * * * *